US006729719B2

(12) United States Patent
Klinefelter et al.

(10) Patent No.: US 6,729,719 B2
(45) Date of Patent: May 4, 2004

(54) IDENTIFICATION CARD PRINTER FORMED FROM A SHEET FEED PRINTER

(75) Inventors: Gary M. Klinefelter, Eden Prairie, MN (US); Martin A. Pribula, Eden Prairie, MN (US); Leonid S. Gershenovich, Eden Prairie, MN (US); Stacy W. Lukaskawcez, Shakopee, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 10/175,766

(22) Filed: Jun. 20, 2002

(65) Prior Publication Data

US 2003/0197771 A1 Oct. 23, 2003

Related U.S. Application Data

(63) Continuation-in-part of application No. 10/126,439, filed on Apr. 19, 2002.

(51) Int. Cl.[7] ..... B41J 2/01; B41J 13/12; B41J 13/18; B65H 1/00

(52) U.S. Cl. ..... 347/101; 347/104; 271/162; 400/521; 400/536; 400/537; 400/541

(58) Field of Search ..... 347/101, 104; 271/162; 400/536, 537, 541, 521

(56) References Cited

U.S. PATENT DOCUMENTS

| | | | | |
|---|---|---|---|---|
| 3,598,396 A | * | 8/1971 | Andrews et al. | 271/111 |
| 3,889,472 A | | 6/1975 | Guillaud | 60/698 |
| 3,960,072 A | | 6/1976 | Ahlgren et al. | 101/35 |
| 4,015,839 A | * | 4/1977 | McKee | 271/37 |
| 4,017,068 A | * | 4/1977 | McKee | 271/275 |
| 4,031,578 A | | 6/1977 | Holloran et al. | 340/172.5 |
| 4,068,028 A | | 1/1978 | Samonides | 428/40 |
| 4,102,267 A | * | 7/1978 | Ritzerfeld | 101/132.5 |
| 4,146,900 A | | 3/1979 | Arnold | 346/75 |
| 4,161,312 A | * | 7/1979 | Eckhardt et al. | 271/3.15 |

(List continued on next page.)

FOREIGN PATENT DOCUMENTS

| | | |
|---|---|---|
| DE | 25 35 699 A1 | 3/1977 |
| EP | 0 562 979 | 9/1993 |
| EP | 0 887 197 | 12/1998 |
| EP | 0 979 736 | 2/2000 |
| GB | 2 120 821 A | 12/1983 |
| JP | 11 265463 | 9/1999 |
| WO | WO 95/09084 | 4/1995 |
| WO | WO 99/04368 | 1/1999 |
| WO | WO 99/21713 | 5/1999 |
| WO | 99/49379 | 9/1999 |

OTHER PUBLICATIONS

"Standard Read/Write Identification IC", by TEMIC Semiconductor GmbH, Heilbronn, Germany, (Apr. 1999).

(List continued on next page.)

*Primary Examiner*—Stephen Meier
*Assistant Examiner*—Leonard Liang
(74) *Attorney, Agent, or Firm*—Westman, Champlin & Kelly

(57) ABSTRACT

In a method of forming an identification card printer a sheet feed printer is provided having a printhead and a sheet feed mechanism that is driven by a sheet feed drive to feed paper sheets to the printhead for printing. Next, the sheet feed mechanism is replaced with a card transport mechanism that is used to feed cards from a card supply to the printhead for printing. The card transport mechanism is then linked to the sheet feed drive through a feed drive link. Finally, a master controller for controlling the operation of the card transport mechanism is installed. Additional aspects of the present invention relate to an identification card printer formed in accordance with the above-described method.

11 Claims, 3 Drawing Sheets

U.S. PATENT DOCUMENTS

| | | | | | |
|---|---|---|---|---|---|
| 4,393,386 | A | | 7/1983 | Di Giulio | 346/75 |
| 4,534,313 | A | | 8/1985 | Louvel | 118/696 |
| 4,604,631 | A | | 8/1986 | Jinnai et al. | 346/1.1 |
| 4,680,596 | A | | 7/1987 | Logan | 346/140 |
| 4,685,702 | A | | 8/1987 | Kazuharu | 283/81 |
| 4,686,540 | A | | 8/1987 | Leslie et al. | 346/33 |
| 4,716,346 | A | | 12/1987 | Matsuo | 318/38 |
| 4,734,868 | A | | 3/1988 | DeLacy | 364/519 |
| 4,781,985 | A | | 11/1988 | Desjarlais | 428/421 |
| 4,797,018 | A | | 1/1989 | Hofmann et al. | 400/208 |
| 4,845,490 | A | | 7/1989 | Ward et al. | 340/825.31 |
| 4,961,088 | A | | 10/1990 | Gilliland et al. | 355/206 |
| 5,111,239 | A | * | 5/1992 | Kamimura et al. | 355/45 |
| 5,138,344 | A | | 8/1992 | Ujita | 400/175 |
| 5,149,211 | A | | 9/1992 | Pettigrew | 400/88 |
| 5,184,181 | A | | 2/1993 | Kurando et al. | 355/260 |
| 5,239,926 | A | * | 8/1993 | Nubson et al. | 101/487 |
| 5,266,968 | A | | 11/1993 | Stephenson | 400/208 |
| 5,267,800 | A | | 12/1993 | Petterutl et al. | 400/88 |
| 5,277,501 | A | | 1/1994 | Tanaka et al. | 400/120 |
| 5,318,370 | A | | 6/1994 | Nehowig | 400/207 |
| 5,327,201 | A | | 7/1994 | Coleman et al. | 355/278 |
| 5,368,677 | A | | 11/1994 | Ueda et al. | 156/362 |
| 5,455,617 | A | | 10/1995 | Stephenson et al. | 400/207 |
| 5,466,319 | A | | 11/1995 | Zager et al. | 156/220 |
| 5,502,464 | A | | 3/1996 | Takahashi et al. | 346/25 |
| 5,516,218 | A | | 5/1996 | Amano et al. | 400/535 |
| 5,646,388 | A | | 7/1997 | D'Entremont et al. | 235/380 |
| 5,695,589 | A | | 12/1997 | German et al. | 156/250 |
| 5,703,347 | A | | 12/1997 | Reddersen et al. | 235/472 |
| 5,707,162 | A | | 1/1998 | Kasal et al. | 400/692 |
| 5,709,484 | A | | 1/1998 | Dorner | 400/188 |
| 5,755,519 | A | | 5/1998 | Klinefelter | 400/249 |
| 5,837,991 | A | | 11/1998 | LaManna et al. | 235/475 |
| 5,936,008 | A | | 8/1999 | Jones et al. | 523/161 |
| 5,980,011 | A | | 11/1999 | Cummins et al. | 347/4 |
| 5,995,774 | A | | 11/1999 | Applegate et al. | 399/27 |
| 6,011,741 | A | | 1/2000 | Wallace et al. | 365/221 |
| 6,037,879 | A | | 3/2000 | Tuttle | 340/825.54 |
| 6,039,430 | A | | 3/2000 | Helterline et al. | 347/19 |
| 6,071,024 | A | | 6/2000 | Chi-Ming et al. | 347/177 |
| 6,072,402 | A | | 6/2000 | Kniffin et al. | 340/825 |
| 6,099,101 | A | | 8/2000 | Maurelli et al. | 347/7 |
| 6,099,178 | A | | 8/2000 | Spurr et al. | 400/207 |
| 6,113,208 | A | | 9/2000 | Benjamin et al. | 347/7 |
| 6,163,658 | A | | 12/2000 | Suzuki | 399/12 |
| 6,213,392 | B1 | | 4/2001 | Zuppicich | 235/380 |
| 6,252,791 | B1 | | 6/2001 | Wallace et al. | 365/221 |
| 6,263,170 | B1 | | 7/2001 | Bortnem | 399/13 |
| 6,264,296 | B1 | | 7/2001 | Klinefelter et al. | 347/4 |
| 6,264,301 | B1 | | 7/2001 | Helterline et al. | 347/19 |
| 6,267,463 | B1 | | 7/2001 | Paulsen | 347/19 |
| 6,271,928 | B1 | | 8/2001 | Bullock et al. | 358/1.16 |
| 6,302,527 | B1 | | 10/2001 | Walker | 347/50 |
| 6,305,795 | B2 | | 10/2001 | Childers et al. | 347/86 |
| 6,312,083 | B1 | | 11/2001 | Moore | 347/19 |
| 6,312,106 | B1 | | 11/2001 | Walker | 347/50 |
| 6,325,495 | B1 | | 12/2001 | Foth | 347/84 |
| 6,371,586 | B1 | | 4/2002 | Saruta | 347/7 |

OTHER PUBLICATIONS

"Introducing the New SmartGuard™ and SmartShield™ Advanced Security Options", pamphlet by Fargo Electronics, Inc., Eden Prairie, Minnesota (1998).

"RFID Tagging IC is First to Accept Input from Sensors", by Microchip Technology Inc., (undated).

Two page web site advertisement from SEIKO Precision, entitled "The lastest design for your CD–R", re: CD Printer 2000.

Two page web site advertisement from SEIKO Precision, entitled "CD Printer 2000".

Two page web site advertisement from SEIKO Precision, entitled "CD Printer 4000".

Partial International Search for International Application No. PCT/US 01/17146, filed May 25, 2001 (with Invitation to Pay Fees).

International Search Report for International Application No. PCT/US 00/01697, filing date Jan. 21, 2000, dated Oct. 18, 2000.

* cited by examiner

IDENTIFICATION CARD PRINTER FORMED FROM A SHEET FEED PRINTER

CROSS REFERENCE TO RELATED APPLICATIONS

The present invention is a Continuation-in-Part of U.S. patent application Ser. No. 10/126,439, entitled "CARD CARTRIDGE AND CARD FEED ADAPTER FOR AN INK JET SHEET FEEDER PRINTER," for inventors Gary M. Klinefelter, Martin A. Pribula, Leonid S. Gershenovich and Stacy W. Lukaskawcez, filed Apr. 19, 2002. Reference is also made to the following related co-pending applications, filed on Apr. 19, 2002: application Ser. No. 10/126,428, entitled "IDENTIFICATION CARD PRINTER HAVING MULTIPLE CONTROLLERS," for inventors Gary W. Klinefelter, Leonid S. Gershenovich, Gary A. Lenz, and Robert E. Francis, application Ser. No. 10/126,427, entitled "IDENTIFICATION CARD PRINTER," for inventors Martin A. Pribula, James R. Meier, Stacy W. Lukaskawcez, Gary M. Klinefelter, Leonid S. Gershenovich, Gary A. Lenz, and Jeffrey D. Upin; application Ser. No. 10/126,441, entitled "CARD CARTRIDGE," for inventors Martin A. Pribula, James M. Meier, Stacy W. Lukaskawcez, Anthony L. Lokken, Gary M. Klinefelter, Gary A. Lenz and Jeffrey D. Upin; application Ser. No. 10/127,024, entitled "CARD TRANSPORT MECHANISM ROLLER SUPPORT," for inventors Martin A. Pribula and Gary M. Klinefelter; and application Ser. No. 10/126,440, entitled "IDENTIFICATION CARD PRINTER DATA ENCODER MODULE," for inventors Darrell T. Olson and Matthew K. Dunham. All of the above-referenced applications are incorporated herein by reference in their entirety.

FIELD OF THE INVENTION

The present invention relates to identification card printers. More particularly, the present invention relates to a method of converting a paper sheet feed printer into an identification card printer by adapting the sheet feeding components of the sheet feed printer to feed and process cards.

BACKGROUND OF THE INVENTION

Ink jet printers have been found to do a satisfactory job of printing on identification cards, and low cost ink jet paper sheet feed printers are available. These ink jet printers are generally provided with paper sheet feed mechanisms that typically feed individual paper sheets such as 8½×11" or A4 size to a printhead for printing. The sheet feed mechanism is specifically adapted to feed these thin, flexible and wide paper sheets. The printhead and the driving components of the sheet feed mechanism are relatively low cost, very accurate, and easily controlled.

Identification card printers have also been advanced for printing on rigid or semi-rigid cards. Identification card printers include their own printheads as well as a card transport mechanism that is specifically adapted to feed the cards to the printhead for processing.

There is a continuing need for improvements to identification card printers including reducing their cost while providing high performance card printing. Therefore, it would be desirable to take advantage of the low cost of high quality sheet feed printers by adapting them to handle the feeding and processing of identification cards.

SUMMARY OF THE INVENTION

The present invention relates to a method of forming an identification card printer from an existing sheet feed printer.

In the method, a sheet feed printer is provided having a printhead and a sheet feed mechanism that is driven by a sheet feed drive to feed paper sheets to the printhead for printing. Next, the sheet feed mechanism is replaced with a card transport mechanism that is used to feed cards from a card supply to the printhead for printing. The card transport mechanism is then linked to the sheet feed drive through a feed drive link. Finally, a master controller for controlling the operation of the card transport mechanism is installed. Additional aspects of the present invention relate to an identification card printer formed in accordance with the above-described method.

DETAILED DESCRIPTION OF THE PREFERRED EMBODIMENTS

Figure 1:
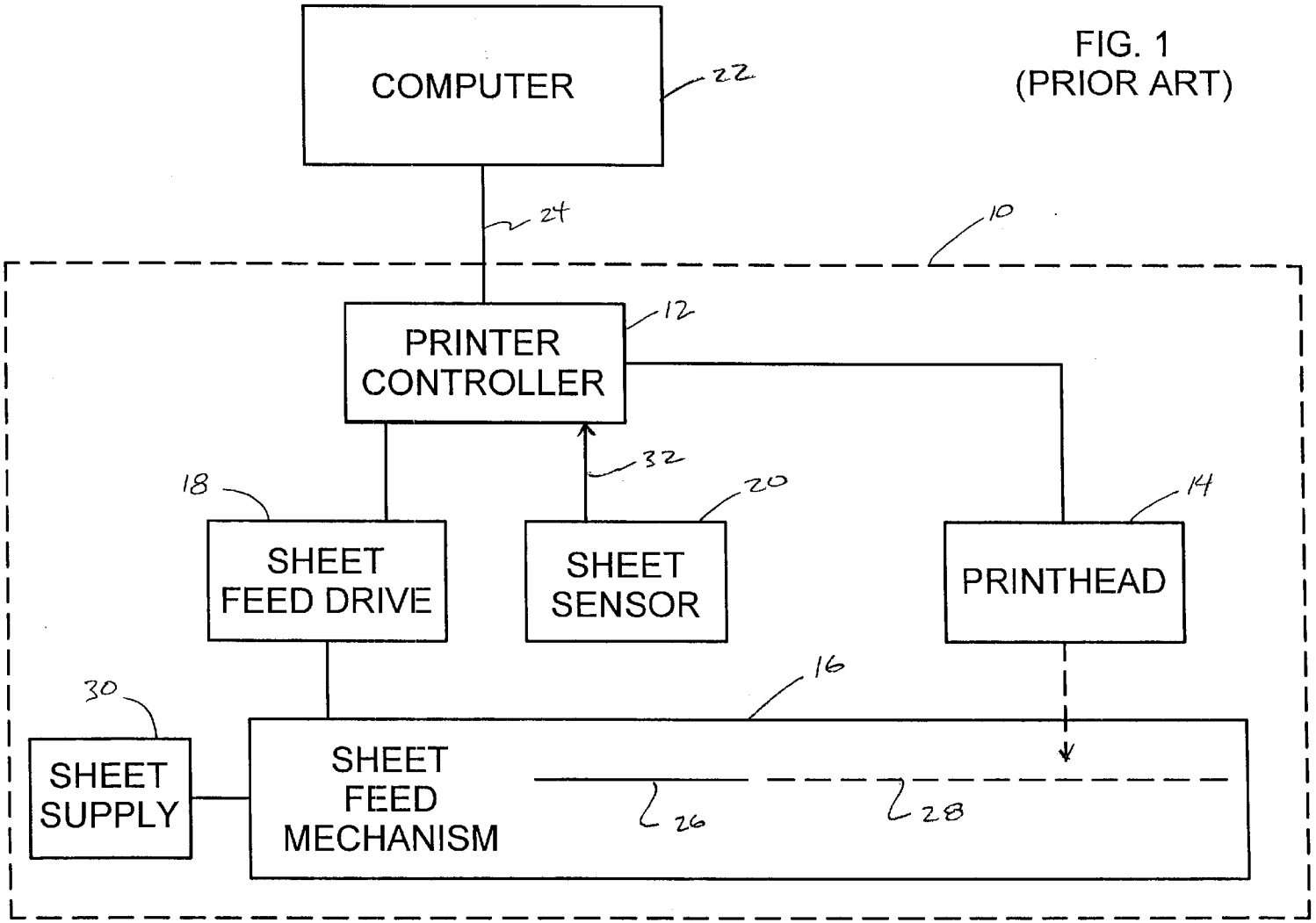
FIG. 1 (PRIOR ART)
FIG. 1 is a schematic diagram of a sheet feed printer in accordance with the prior art.

The present invention relates to a method of converting a sheet feed paper printer to an identification card printer that is formed by such a conversion. A typical sheet feed paper printer, in accordance with the prior art, is shown schematically in FIG. 1. Printer 10 generally includes a printer controller 12, a printhead 14, a sheet feed mechanism 16 driven by a sheet feed drive 18, and a sheet sensor 20. One example of such a sheet feed printer 10 is the Hewlett Packard Model No. 940 Ink Jet Printer.

Printer controller 12 receives a print job generated by applications running on computer 22 through a suitable connection 24. Printer controller 12 controls the operations of printer 10 including the operation of sheet feed mechanism 16 and printhead 14 to process the print job. Printhead 14 can be an ink jet printhead having color and black ink supplies, a thermal printhead in combination with a thermal print ribbon, or other suitable print mechanism.

Printhead 14 is adapted to print onto a surface of a paper sheet 26 that is presented in a print position. Printhead 14 can also include a positioning mechanism for moving printhead 14 back and forth along a line that is transverse to sheet 26 in accordance with known methods. Printhead 14 generally prints multiple image lines on the sheet 26 to form the desired image as sheet 26 is moved along print path 28 by sheet feed mechanism 16.

Sheet feed mechanism 16 generally receives individual paper sheets 26 from sheet supply 30 and delivers individual sheets 26 to printhead 14 along print path 28 and presents the sheets 26 to printhead 14 for printing thereon. Sheet feed mechanism 16 can include multiple feed and drive rollers that are driven by sheet feed drive 18, which generally includes an electric motor. Sheet feed mechanism 16 cannot handle and feed card substrates used to form identification cards due to their small length and width, large thickness, and inflexibility relative to paper sheets.

Sheet sensor 20 can provide a signal 32 to printer controller 12 to indicate the presence of a sheet 26 being fed by sheet feed mechanism 16. Sheet sensor 20 can be an LED sensor or other suitable mechanical or electrical sensor used to detect the presence of a sheet 26.

Figure 2:
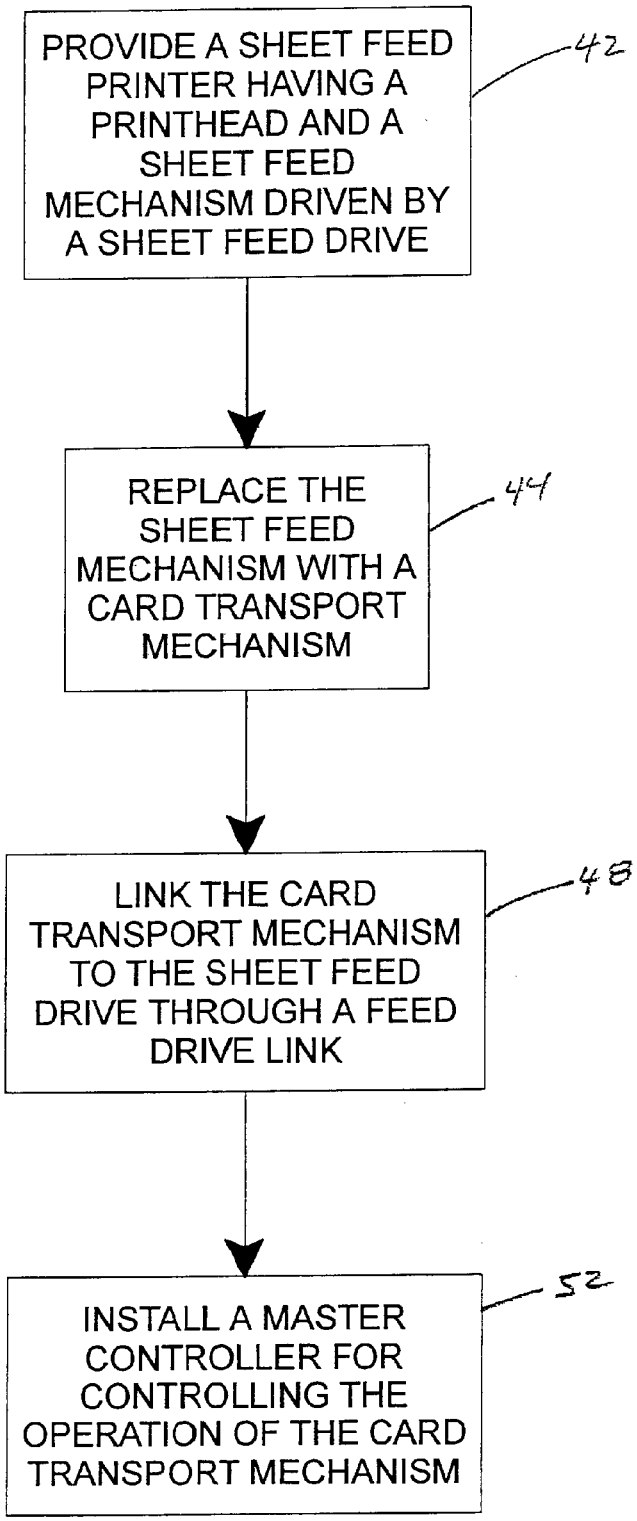
FIG. 2 is a flowchart illustrating a method of converting a sheet feed printer to an identification card printer in accordance with an embodiment of the invention.
Figure 3:
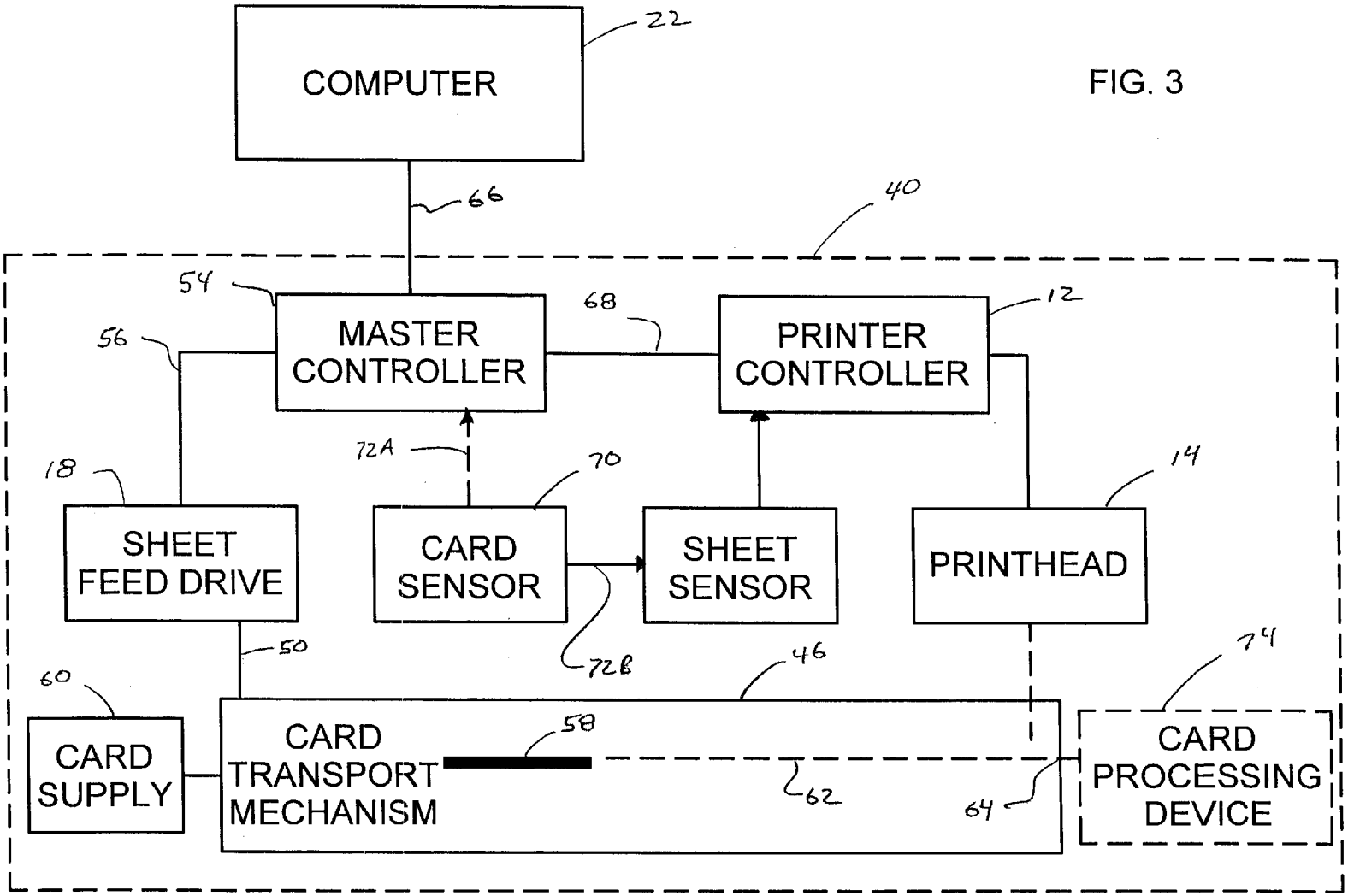
FIG. 3 is a schematic diagram of an identification card printer formed by converting an existing sheet feed printer in accordance with embodiments of the invention.

The present invention relates to a method of converting a sheet feed paper printer to an identification card printer that is formed by such a conversion. FIG. 2 is a flowchart illustrating steps of the method for converting a sheet feed printer to an identification card printer and FIG. 3 is a schematic diagram of an identification card printer 40 that has been formed from a sheet feed printer 10 in accordance with various embodiments of the invention.

The formation of identification card printer 40 generally involves providing a sheet feed printer, such as printer 10, having a printhead 14 and sheet feed mechanism 16 driven by sheet feed drive 18, as indicated at step 42 of FIG. 2. Next, at step 44, sheet feed mechanism 16 is replaced with a card transport mechanism 46, shown in FIG. 3. At step 48, card transport mechanism 46 is linked to sheet feed drive 18 through feed drive link 50. Finally, at step 52, a master controller 54, is installed to control card transport mechanism 46 through, for example, the control of sheet feed drive 18, as illustrated by connection 56.

Card transport mechanism 46 is generally configured to receive individual cards 58 from a card supply 60 contained in, for example, a card cartridge, and transport them along a print path 62 to printhead 14 for printing. Unlike sheet feed mechanism 16, card transport mechanism 46 includes feeding components that are adapted to handle the rigid or semi-rigid cards 58, which are substantially thicker than paper sheets 26. Card transport mechanism 46 preferably includes multiple feed, drive, and/or pinch rollers to control the feeding of individual cards 58 along print path 62. Card transport mechanism 46 also includes an output 64 for discharging processed cards 58 to an output hopper or other card processing device.

As mentioned above, card transport mechanism 46 is driven by sheet feed drive 18 through feed drive link 50. Feed drive link 50 can include belts, gears, or other suitable mechanisms for driving the feeding components of card transport mechanism 46. These components can be configured such that card transport mechanism 46 delivers cards to printhead 14 as desired.

Master controller 54 is preferably configured to receive print jobs from applications running on computer 22 through a suitable connection 66. In accordance with one embodiment, master controller 54 includes a Universal Serial Bus (USB) hub to which computer 22 is connected through USB connection 66. Other components of identification card printer 40, such as printer controller 12, can also be connected to the USB network through the USB hub of master controller 54. Master controller 54 can communicate information to printer controller 12 through connection 68 and communicate with and/or control the operations of other components of identification card printer 40, such as card supply 60, through suitable connections. For example, master controller 54 can be configured to communicate with security or identification tags on card supply 60, printhead 14, or other component of identification card printer 40. These tags can provide, for example, data and security signals that can be used to ensure that the component is authorized for use in identification card printer 40.

In accordance with one embodiment of the invention, identification card printer 40 includes a card sensor 70. Card sensor 70 is positioned to detect the presence of a card 58 being processed and produce a signal 72 in response to the detection of such a card 58. Card sensor 70 can be any suitable type of sensor, such as an LED sensor.

In accordance with one embodiment of the invention, signal 72 is provided directly to master controller 54 as indicated by arrow 72A. Master controller 54 can use the signal to control the operations of card transport mechanism 46 and provide necessary signals to printer controller 12 to process a card 58.

In accordance with another embodiment of the invention, signal 72 is directed to sheet sensor 20 as indicated at arrow 72B. Signal 72B is used to control the operation of sheet sensor 20 and, thus, control when signal 32 is produced by sheet sensor 20. In accordance with this embodiment of the invention, sheet sensor 20 is not used to detect the presence of a sheet or card being processed, but is controlled to provide the signal 32 to printer controller 12 at the desired time for the proper processing of a card 58.

Identification card printer 40 can also be configured to include, or be attached to, one or more card processing devices, as indicated in FIG. 3 at 74. Card processing devices 74 can include a data encoder (e.g., smart card chip encoder or magnetic stripe writer), a card reader, a laminator, a printer security device (e.g., a biometric data reader), and other card processing devices. Card processing devices 74 can, for example, be positioned adjacent output 64 of card transport mechanism 46 to receive printed cards 58 therefrom and perform further processing, such as data encoding.

Although the present invention has been described with reference to preferred embodiments, workers skilled in the art will recognize that changes may be made in form and detail without departing from the spirit and scope of the invention.

What is claimed is:

1. An identification card printer converted from a paper sheet feed printer having a printhead, a sheet feed mechanism driven by a sheet feed drive, and a printer controller configured to control the sheet feed mechanism and the printhead to process paper sheets, the identification card printer comprising:

a card transport mechanism replacing the sheet feed mechanism, the card transport mechanism configured to feed cards from a card supply to the printhead for printing;

a sheet feed drive link mechanically coupling the sheet feed drive to the card transport mechanism; and a master controller for controlling the card transport mechanism.

2. The printer of claim 1, wherein the master controller is in signal communication with the printer controller.

3. The printer of claim 1, including a card sensor for sensing a presence of a card being processed, the card sensor including a signal directed to the master controller.

4. The printer of claim 1, including a card sensor for sensing a presence of a card being processed, the card sensor including a signal directed to a sheet feed sensor of the sheet feed printer.

5. The printer of claim 1, wherein the printhead is an ink jet printhead.

6. The printer of claim 1, including a data encoder for encoding data on the cards.

7. A method of forming an identification card printer comprising steps of:

a) providing a sheet feed printer having a printhead and a sheet feed mechanism driven by a sheet feed drive for feeding paper sheets to the printhead for printing;

b) replacing the sheet feed mechanism with a card transport mechanism for feeding cards from a card supply to the printhead for printing;

c) linking the card transport mechanism to the sheet feed drive through a feed drive link; and d) installing a master controller to control the operation of the card transport mechanism.

8. The method of claim 7, wherein:

the sheet feed printer includes a sheet sensor including a signal indicating the presence of a sheet being processed; and the method includes steps of:

e) providing a card sensor having a signal indicating the presence of a card being processed; and d) using the signal produced by the card sensor to control the operation of the sheet sensor.

9. A method of converting a sheet feed printer into an identification card printer, the sheet feed printer originally having a printhead, a sheet feed mechanism for feeding paper sheets to the printhead for printing, a sheet feed drive for driving the sheet feeder, and a printer controller for controlling the operations of the printhead, the method comprising steps of:

a) replacing the sheet feed mechanism with a card transport mechanism for feeding cards from a card supply to the printhead for printing;

b) linking the card transport mechanism to the sheet feed drive, whereby the sheet feed drive operates to drive the card transport mechanism; and c) installing a master controller for controlling the operation of the card transport mechanism.

10. The method of claim 9, wherein:

the sheet feed printer further originally includes a sheet sensor including a signal indicating the presence of a sheet being fed by the sheet feeder; and the method including steps of:

d) providing a card sensor having a signal indicating the presence of a card being processed; and e) using the signal produced by the card sensor to control the operation of the sheet sensor.

11. The method of claim 9 including a step d) of communicating signals between the master controller and the printer controller.

* * * * *

UNITED STATES PATENT AND TRADEMARK OFFICE

CERTIFICATE OF CORRECTION

PATENT NO. : 6,729,719 B2 
DATED : May 4, 2004
INVENTOR(S) : Gary M. Klinefelter et al.

It is certified that error appears in the above-identified patent and that said Letters Patent is hereby corrected as shown below:

Title page,
Item [56], References Cited, U.S. PATENT DOCUMENTS, insert:

| | | |
|---|---|---|
| --3,755,653 | 8/1973 | Venker |
| 4,782,363 | 11/1988 | Britt et al. |
| 5,019,839 | 5/1991 | Watanabe et al. |
| 5,077,467 | 12/1991 | Barron, Jr. et al. |
| 5,530,468 | 6/1996 | Yoshimi et al. |
| 5,642,877 | 7/1997 | Green |
| 5,772,199 | 6/1998 | Green |
| 5,820,281 | 10/1998 | Hill et al. |
| 5,882,127 | 3/1999 | Amano |
| 5,978,621 | 11/1999 | Glemser et al. |
| 6,076,913 | 6/2000 | Garcia et al. |
| 6,179,401 | 1/2001 | Stephens, Jr. et al. |
| 6,253,329 | 6/2001 | Kang |
| 6,341,839 | 1/2002 | Burikov et al. |
| 6,405,055 | 6/2002 | Silverbrook et al. |
| 6,464,317 | 10/2002 | Miyazawa-- |

FOREIGN PATENT DOCUMENTS, insert:
-- JP 411105359A 4/1999 --

OTHER PUBLICATIONS, insert:

--Streamfeeder - ST 1250 Universal Friction Feeder; last modified February 27, 2000; 1 page with heading of "Streamfeeder - Product Index"; and 3 pages with heading of "Streamfeeder - ST 1250 Universal Friction Feeder"--

Signed and Sealed this

Twenty-first Day of September, 2004

JON W. DUDAS
*Director of the United States Patent and Trademark Office*